United States Patent [19]

Lewis

[11] 3,948,679

[45] Apr. 6, 1976

[54] CLEANING LIQUID SYSTEMS INCLUDING CONTROLLED HEATING AND COOLING OF THE LIQUID

[75] Inventor: George W. Lewis, Metairie, La.

[73] Assignee: Halliburton Company, Duncan, Okla.

[22] Filed: Nov. 27, 1974

[21] Appl. No.: 527,795

[52] U.S. Cl. ..... 134/10; 134/17; 134/22 C; 134/34; 134/107; 134/108; 134/111; 184/1 E

[51] Int. Cl.[2] ..... B08B 3/10

[58] Field of Search ..... 134/10, 17, 22 R, 22 C, 134/30, 34, 35, 107, 108, 111, 169 R, 169 A, 169 C; 137/15; 184/6.11, 6.22, 6.24, 1 E; 165/2, 58

[56] References Cited

UNITED STATES PATENTS

| | | | |
|---|---|---|---|
| 1,191,451 | 7/1916 | Morterud | 134/17 |
| 2,076,847 | 4/1937 | Johnston | 134/17 X |
| 2,254,980 | 9/1941 | Simmons | 134/17 |
| 2,600,820 | 6/1952 | Whatley | 134/17 |
| 3,029,898 | 4/1962 | Fraser | 134/10 X |

OTHER PUBLICATIONS

"Report By Turbine Oil System Cleaning Task Force", Power Station Chemistry Subcommittee, Prime Movers Committee, EEI; Apr. 30, 1973.

*Primary Examiner*—S. Leon Bashore
*Assistant Examiner*—Richard V. Fisher
*Attorney, Agent, or Firm*—Thomas R. Weaver; John H. Tregoning; Joseph R. Magnone

[57] ABSTRACT

A method for removing adherent deposits from metal surfaces is disclosed. The method comprises contacting the adherent deposits with a liquid and then heating and cooling the liquid in alternation for a time sufficient to dislodge the deposits from the surfaces.

25 Claims, 1 Drawing Figure

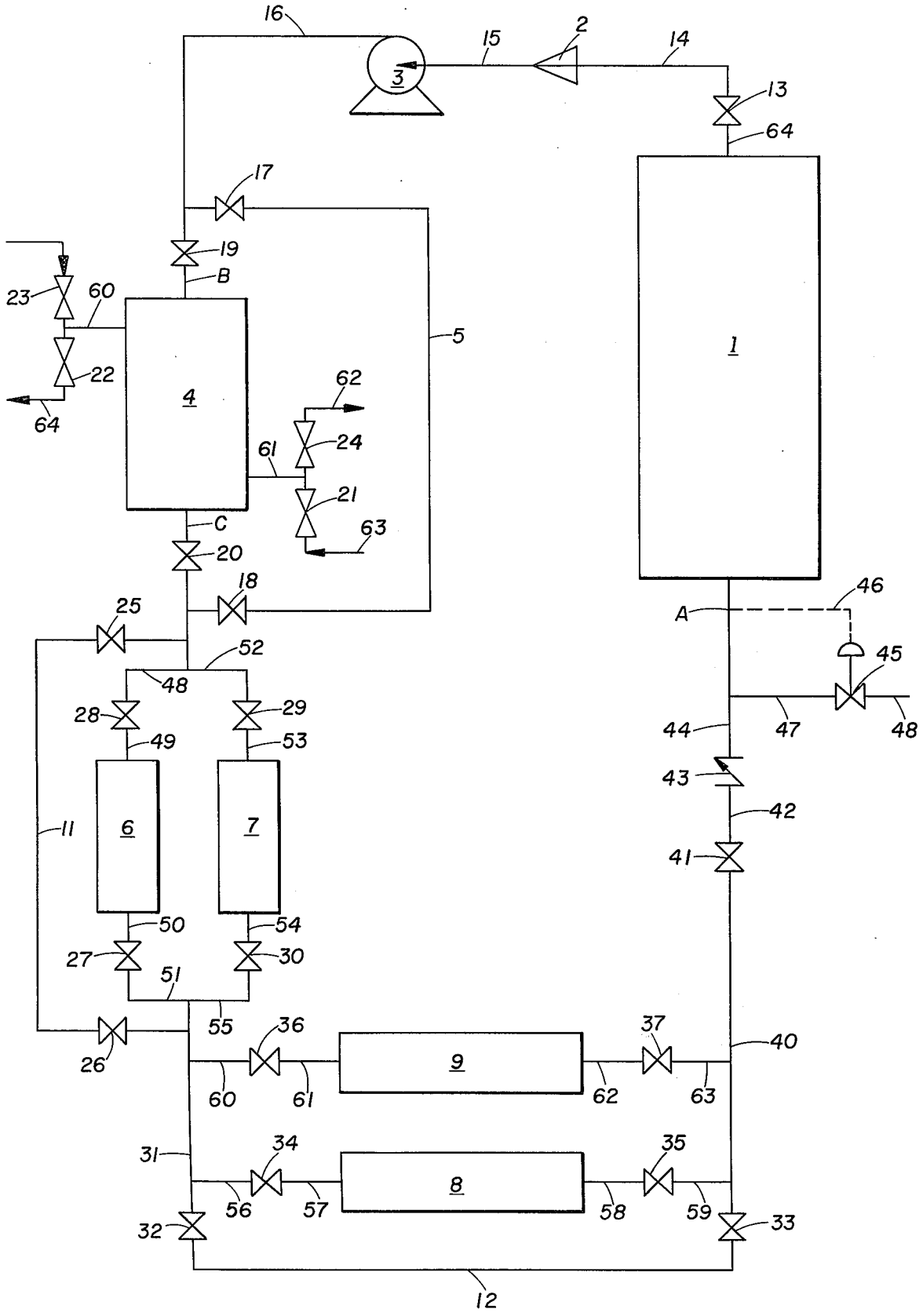
16
15
2
14
3
13
64
17
19
B
23
60
5
1
22
4
62
64
24
61
21
C
63
20
18
46
25
A
52
45
48
28
29
44
47
48
49
53
43
42
11
6
7
41
50
54
27
30
51
55
36
37
40
26
9
60
61
62
63
31
34
35
8
56
57
58
59
32
33
12

CLEANING LIQUID SYSTEMS INCLUDING CONTROLLED HEATING AND COOLING OF THE LIQUID

This invention relates to a method of cleaning systems having liquid circulating therein. This invention further relates to a method for removing debris, dirt, trash and particulate matter from liquids circulating in lubricating systems. This invention still further relates to a pre-operational cleaning method for removing scales adhering to the inner surfaces of conduits and equipment of lubricating oil systems and thereafter removing the scales from the oil circulating in the system.

Certain types of operating equipment include systems which involve the circulation of liquid within the system. Such systems function to protect the equipment against damage or otherwise preserve desirably high operating efficiency of the equipment. Examples of such circulating liquid systems include: lube oil systems to turbine generators, pump, fan and compressor bearings, steel mill rolling machines, circulating liquid cooling systems, hydraulic press systems and hydraulic control systems.

These and similar circulating liquid systems all have at least one thing in common: they become contaminated with dirt, trash, scale, particulate matter and similar solid fouling material which is foreign to the liquid circulating in the system. Some of the fouling material is suspended in the circulating liquid while other of it, such as corrosion and decomposition products, scale and rust, adheres to the surfaces of the system which are in direct contact with the circulating liquid. The contamination of circulating liquid systems with fouling material is particularly evident in new systems which have not actually been placed in operating service. The source of the fouling material in the pre-operational system is based upon construction debris, mill scale, weld slag, and other such foulants normally associated with new construction.

The fouling material must be removed from both pre-operational and operational systems prior to operation or further operation in order to avoid damage to or preserve operating efficiency of the system and/or its associated equipment. One method for removing the fouling material, particularly that which is suspended in the liquid, would involve complete draining of the liquid followed by addition of fresh or otherwise foulant-free liquid to the system. Of course, this method could also include appropriate mechanical and/or chemical steps to remove matter adhering to the walls of the system prior to addition of the fresh liquid. An objection to the method requiring complete replacement of the dirty liquid resides in the volume of the liquid to be replaced. As the size of the system and thus the volume of liquid increases, this particular objection becomes more important.

The invention hereinafter disclosed permits the pre-operational cleaning of circulating oil systems and also the operational cleaning of such systems without requiring the removal and replacement of the liquid circulating in the system.

There has been developed and used in the industrial cleaning industry a method for cleaning circulating liquid systems, for example, lube oil systems, which does not require the removal of the lubricating oil from the system nor the replacement thereof with fresh liquid. This method involves removal of the system from operational service followed by filtration of the circulating liquid for substantial removal of all suspended solid particulate matter of sizes greater than some acceptable maximum. This filtration treatment, however, does not contain reliable steps for the removal of that fouling material which adheres to the surfaces of the system. Furthermore, the filtration treatment now utilized does not feature filtration of all liquid in the system, that is, some dirty liquid bypasses the filtration elements and is commingled with filtered liquid to thereby recontaminate the filtered liquid.

The practice of commingling filtered liquid and dirty liquid requires unduly extended periods of filtration in order to achieve desirably low concentrations of solid particle contamination of the circulating liquid. In addition, the lack of a reliable technique for the removal of adherent scale, rust, and other deposits from interior surfaces which are in direct contact with the circulating liquid contributes an element of doubt as to whether or not the system is truly cleansed of large particles which may at any time flake off of these surfaces subsequent to the termination of a lengthy, but apparently successful, filtration treatment and cause perhaps unacceptably severe damage to equipment and require further interruption of operational service.

In one aspect of this invention there is provided an improvement in the above described filtration treatment of circulating liquid systems which features a reliable technique for removing adherent deposits from interior surfaces which are in direct contact with circulating liquid and which is also characterized by filtration of all liquid and the elimination of the by-passing heretofore practiced.

This invention is based upon the discovery that deposits adhering to surfaces in direct contact with liquid can be effectively dislodged by repeatedly heating and cooling the liquid wherein each period of heating and cooling is separated by a specified interval of time and further wherein each heating period and each cooling period is conducted at a controlled heating rate and a controlled cooling rate respectively.

Thus, according to this invention, there is provided a process for removing adherent rust, scale, weld slag and other deposits from metal surfaces, particularly from ferrous metal surfaces, wherein the process broadly comprises contacting the deposit-containing metal surfaces with a liquid wherein the temperature of the liquid is: increased at a controlled rate to a desirably high temperature; the heating rate of the liquid is then adjusted to maintain the desirably high temperature for a specified period of time; the temperature of the liquid is thereafter decreased at a controlled rate to a desirably low temperature; and the cooling rate of the liquid is then adjusted to maintain the desirably low temperature for a specified period of time. The above described heat-cool process is repeated until the adherent deposits are substantially dislodged from the metal surfaces being contacted by the liquid.

The heat-cool process of this invention is preferably conducted in two phases and still more preferably it is conducted in three phases. According to the two-phase treatment, during the first phase of the process, the heating rate of the liquid and the cooling rate of the liquid are relatively slow, that is in the range of about 40° to about 160°F per hour, and the high and low temperature maintenance times are relatively short, that is in the range of about 1 to about 2 hours; while during the second phase of the process the heating and cooling rates are relatively rapid, that is in the range of about 80° to about 320°F per hour, and the high and low temperature maintenance times are relatively long, that is in the range of about 3 to about 6 hours. According to the more preferred three-phase process, a phase intermediate the first phase and the second phase of the above referred to two-phase process is utilized. The intermediate phase utilizes the relatively rapid heating and cooling rates of the second phase and the relatively short high and low temperature maintenance times of the first phase.

The first phase liquid heating rate is perferably in the range of about 40° to about 80°F per hour while the second phase liquid heating rate is preferably in the range of about 80° to about 160°F per hour.

The first phase liquid cooling rate is preferably in the range of about 80° to about 160°F per hour while the second phase liquid cooling rate is preferably in the range of about 160° to about 320°F per hour.

It is believed that the heating, cooling and temperature maintenance features of the process of this invention cause the adherent deposits to pop, peel or otherwise flake off of the metal surfaces. This physical removal of deposits is evidenced by the presence, or increased presence, of solid particulate matter in the liquid. Accordingly, the process is considered to be complete when the evidence of this physical removal of deposits from the surfaces is substantially diminished or otherwise absent.

It has been observed that the size of the particles which flake off of the metal contacted appears to be a function of the heating and cooling rate and temperature maintenance times utilized. Thus, during the first phase, as referred to previously, the particle size of the deposits is greater than 100 mesh (U.S. Sieve Series); during the intermediate phase, as referred to previously, the particle size is smaller than 100 mesh but larger than 25 micron; and during the second phase, as previously referred to, the particle size is smaller than 25 micron.

The mechanism of the deposit removal process of this invention appears to be based upon thermal shock, but this mechanism is not currently fully understood or confirmed; however, it is believed that during the first and intermediate phases, steady state heat transfer is established across the deposits but is not established across the metal being cleaned. Therefore, the heating of the deposit causes it to expand more than the underlying metal. This expansion, followed by the sudden cooling, causes the deposit to contract by an amount greater than the contraction of the underlying metal, thus causing the formation of relatively large flakes of deposit. During the second phase it is believed that steady state heat transfer is established across both the remaining deposits and the metal. Thus, during the second phase, the expansion and contraction of both the remaining deposits and the metal is more uniform, which results in the formation of smaller particulate matter. It is to be understood that the mechanism involved herein is not clearly known and this invention is not limited nor bound by the explanation thereof.

The disclosure thus far has been drawn to the use of a static liquid. It has been observed that movement of the liquid during the heating and cooling cycles enhances the removal of deposits. It has also been observed that vibrating the equipment to be cleaned or hammering thereof has a beneficial result in the removing of deposits.

The invention shall now be further disclosed in more specific terms in connection with the description of the accompanying FIGURE which is a schematic representation of one preferred embodiment of the process of this invention which involves the cleaning of a lube oil system of a large item of equipment, such as a turbine.

Referring now to the FIGURE, the lubricating oil system 1 of a piece of operating equipment is connected by suitable conduits to primary trap 2, pump 3, indirect heat exchanger 4, by-pass 5, strainer 6, strainer 7, by-pass 11, filter 8, filter 9, and by-pass 12. Strainer 6, strainer 7, and by-pass 11 are connected in parallel flow arrangement; filter 8, filter 9, and by-pass 12 are connected in parallel flow arrangement; and heat exchanger 4 and by-pass 5 are also connected for parallel flow.

After the lube oil system 1 of the equipment to be cleaned is connected as indicated in the FIGURE, the cleaning operation proceeds as follows:

Lube oil flows from system 1, via open valve 13, and conduit 14, through primary trap 2 to the suction side of pump 3, via conduit 15. Primary trap 2 functions to protect pump 3 from trash and large debris which could damage or otherwise plug the pump. Primary trap 2 is therefore sized to remove objects greater than about 3/16 to about one-fourth of an inch in diameter.

From pump 3 the lube oil is pumped via conduit 16 through open valve 17, through by-pass 5, and through open valve 18. During this initial period of the process the oil to be cleaned does not pass through the heat exchanger, thus valves 19 and 20 are closed and valves 17 and 18 to by-pass 5 are open. It is clear then that coolant inlet valve 21 and coolant outlet valve 22 are closed and heating inlet valve 23 and heating outlet valve 24 are closed.

From open valve 18, the oil passes to and through by-pass 11 via open valve 25 and passes from by-pass 11 via open valve 26. During this initial period of the process, the oil to be cleaned does not pass through strainer 6 or strainer 7, thus while fluid is passed through by-pass 11, valves 25 and 26 are open and valves 27, 28, 29, and 30 are closed.

From by-pass 11, the oil flows through the open valve 26, and passes around filters 8 and 9 via conduit 31, open valve 32, by-pass 12, and open valve 33. During this initial period of the process, valves 34, 35, 36, and 37 are closed.

Oil passes from by-pass 12 and returns to system 1 via open valve 33, conduit 40, open valve 41, conduit 42, check valve 43, and conduit 44.

System 1 is protected by normally closed pressure relief valve 45. In the event the pressure exerted by the pumped oil at point A in conduit 44 exceeds a specified set point, pressure relief valve 45 will open in response to a signal transmitted thereto via signal transfer line 46 and oil will pass from conduit 44 via conduit 47 through pressure relief valve 45 and through conduit 48 to an oil storage zone which is not shown.

During the initial period of the process as described above, the oil does not pass through heat exchanger 4, strainers 6 and 7, and filters 8 and 9. During this period oil circulation at specified pressure and flow rate for system 1 is established, any trapped air is vented, and the various cleaning system and lube oil system connections are examined for leaks and malfunction under the specified operating conditions. For purposes of this disclosure and by way of example, but not by way of limitation, the specified pressure and flow rate for system 1 is 70 psig and 5000 gpm, respectively, as measured upstream of system 1 in conduit 44 at point A. Also, during this period trap 2 is constantly monitored and large debris which becomes trapped therein is removed. It is to be understood that removal of such debris could require termination of oil circulation while trap 2 is being cleared of plugging debris; however, to avoid termination of circulation, a back-up trap in parallel can be employed.

Circulation of the oil is continued during this initial period for a time sufficient to repair malfunctions and the like and until the pressure drop across trap 2 is substantially negligible after a reasonable period of continuous circulation.

After oil circulation is well established and flow through trap 2 has continued without substantial pressure drop for a reasonable period of time, e.g. about 12 to 14 hours, valves 27 and 28 are opened and valves 25 and 26 are closed. This will terminate flow through bypass 11 and initiate flow through strainer 6 via conduit 48, valve 28, and conduit 49. Oil flows from strainer 6 and through conduit 50, valve 27, and conduit 51 to conduit 31 and bypass 12. Oil circulation then continues as described previously.

All oil is passed through strainer 6; there is no bypassing. Accordingly, strainer 6 is preferably sized to accommodate a desirably high oil flow rate through the strainer without exceeding some specified maximum input pressure limitation of the particular strainer utilized.

A desirably high flow rate is defined herein to mean a linear rate of flow which is sufficiently rapid to enable the flowing oil to maintain particles in suspension and to move them to the strainer and filtering elements for entrapment and removal.

In one preferred embodiment, strainer 6 is a 100 mesh (U.S. Sieve Series) unit which can accommodate a volumetric flow rate of 5000 gallons per minute (gpm) without exceeding a maximum input pressure limitation of 150 pounds per square inch gauge (psig) measured at a point upstream of strainer 6 in conduit 49.

It is to be understood that the representation of strainer 6 (and strainer 7) in the Figure is not to be construed as an indication of a single piece of apparatus. Strainer 6 can be indicative of a single piece of equipment and it can also be indicative of a number of strainers connected in parallel.

The pressure difference across strainer 6 is continuously monitored. When the pressure upstream of strainer 6, as measured in conduit 49, exceeds the pressure downstream of strainer 6, as measured in conduit 50, by about 25 psi, the indication is that the particulate matter trapped in strainer 6 is starting to impede satisfactory oil flow. Accordingly, valves 29 and 30 are opened and valves 27 and 28 are closed. This will terminate flow through strainer 6 and initiate flow through strainer 7 via conduit 52, valve 29 and conduit 53. Oil flows from strainer 7 and through conduit 54, valve 30 and conduit 55 to conduit 31 and bypass 12.

The pressure difference across strainer 7 is monitored just as described with respect to strainer 6. Thus, when the pressure as measured in conduit 53 is about 25 psi greater than the pressure as measured in conduit 54, then oil flow through strainer 7 is terminated by closing valves 29 and 30 and oil flow through strainer 6 is initiated by opening valves 27 and 28. It is to be understood that while oil is flowing through strainer 7 and not flowing through strainer 6, then the particulate matter trapped in strainer 6 is being removed and that strainer 6 is being prepared for future use and, conversely, while oil is flowing through strainer 6 and not flowing through strainer 7, then strainer 7 is being similarly cleaned and prepared for future use.

Strainers 6 and 7 are used in alternate fashion as above described for a period of time sufficient to remove from the circulating oil substantially all suspended matter which will not pass through a 100 mesh (U.S. Sieve Series) screen. It is considered that such a condition is established when circulation of oil through a specific strainer can be continued for a period of about 2 hours without exceeding the above referred to 25 psi differential.

After the particles of a size greater than about 100 mesh have been removed as above described, the oil is continued to flow through strainers 6 and 7, but, in addition, it is then directed through one of filters 8 and 9 and heat exchanger 4 as hereinafter described. During this portion of the process, filters 8 and 9 are equipped with 25 micron filter elements; that is, particles having a size of 25 micron and greater will not pass through these filters. Accordingly, valves 34 and 35 are opened and valves 32 and 33 are closed to thereby terminate flow of oil through bypass 12 and to thereby initiate the flow of oil through filter 8 via conduit 31, conduit 56, valve 34, and conduit 57. Oil flows from filter 8 conduit 40 via conduit 58, valve 35, and conduit 59. The oil then returns to system 1 via conduits 40, 42, and 44, and valves 41 and 43 as described above.

Valves 19 and 20 are opened and valves 17 and 18 are closed to thereby terminate the flow of oil through bypass 5 and to initiate the flow of oil through heat exchanger 4. At this point then, oil flows from system 1, through trap 2, through heat exchanger 4, one of strainers 6 and 7, and one of filters 8 and 9. There is no bypassing; that is, oil does not flow through bypass 5, bypass 11, or bypass 12.

Up to this point, the oil has been circulating at ambient temperature. With the oil now passing through heat exchanger 4, one of strainers 6 and 7 and one of filters 8 and 9, it is ready for heating and cooling in accordance with the process of this invention. Prior to heating, the thermal characteristics, particularly the thermal degradation temperature, of the oil must be determined. The temperature of certain oils can not exceed certain values for various reasons; accordingly, the limiting high temperature for the oil involved must be determined. The lube oil is now ready to be heated to the established high temperature which, for purposes of illustration only, is stated to be 200°F.

A heating medium, such as steam, is admitted to indirect heat exchanger 4 by opening valve 23 and opening condensate outlet 24. At this point, valves 21 and 22 are not open. Steam passes through valve 23 and conduit 60, passes in indirect heat exchange with the oil in heat exchanger 4 and the condensed or otherwise cooled steam exits heat exchanger 4 via conduit 61 and open valve 24. The condensate is then delivered to suitable equipment, not shown, via conduit 62.

The flow rate of steam through heat exchanger 4 is adjusted by suitable manipulation of valve 23 to produce a uniform heating rate of the oil as it passes through heat exchanger 4. This portion of the process has been referred to previously as the first phase treatment of the heat-cool process. Thus, the first phase heating rate of the oil should be adjusted such that the difference in oil temperature between the oil entering heat exchanger 4 at, for example, point B, and the temperature of the oil leaving heat exchanger 4 at, for example, point C, is in the range of about 10° to 15°F. That is, the temperature of the oil at point C is in the range of about 10° to 15°F greater than the temperature of the oil at point B.

Heating at the first phase controlled rate described above is continued until the temperature of the oil at C reaches the upper temperature limit initially established, which for purposes of this description is 200°F. The heating rate of the oil is then varied to maintain the oil temperature at point C at about 200°F. This would require that less steam be admitted via conduit 60; accordingly, valve 23 is throttled toward a closed position. The temperature at C is maintained substantially constant for approximately one to two hours, thereafter valves 23 and 24 are closed thus terminating the flow of steam to the heat exchanger.

Cooling of the oil is thereafter effected by passing a suitable coolant, such as water at ambient temperature, in indirect heat exchange relationship with the oil. Thus, valve 21 and valve 22 are open. Cooling water at ambient temperature is passed through conduit 63, open valve 21, conduit 61, through indirect heat exchanger 4, through conduit 60, open valve 22, and conduit 64. From conduit 64 the coolant is then passed to other equipment, not shown. The flow rate of the cooling water through indirect heat exchanger 4 is adjusted by suitable manipulation of valve 21 to produce a uniform cooling rate of the oil as it passes through heat exchanger 4 such that the difference in oil temperature between the oil entering the heat exchanger via valve 19 and the oil leaving the heat exchanger via valve 20 is maintained in the range of about 10° to 15°F. That is, the first phase cooling rate of the oil is adjusted such that the oil temperature at C during cooling is maintained at a temperature of about 10° to 15°F lower than the temperature of the oil at point B.

Cooling at the first phase controlled rate described above is continued until the temperature of the oil at C assumes an equilibrium temperature. At equilibrium, the temperature of the cooled outlet oil at point C approaches the temperature of the cooling water entering via conduit 63 and becomes virtually constant. The equilibrium temperature is maintained for about 1 to 2 hours, thereafter the above described first phase heating-cooling cycle is repeated.

During the first phase treatment, adherent scale contacted by the circulating oil in system 1 is loosened and begins to flake off. The loosened scale is then carried by the moving oil to trap 2 and one of strainers 6 and 7, and possibly to one of filters 8 and 9. However, during this first phase of the process, the particles are generally small enough to pass through trap 2 but large enough to be retained on one of strainers 6 and 7. Some material, of course, passes through strainer 6 and strainer 7 and is trapped in one of filters 8 and 9. Primarily, however, during this first phase, the 100 mesh strainers 6 and 7 are the primary filtering elements.

Throughout the entire first phase the heating and cooling rates and the temperature maintenance times are continued as above described, and monitoring, controlling and cleaning of strainers 6 and 7 is continued, also as above described. The first phase treatment is considered to be complete when circulation of oil through strainer 6 or strainer 7 can be continued without interruption for a period of about 12 hours while maintaining a substantially constant pressure difference across the strainer.

It was noted that oil passed through one of filters 8 and 9 during the first phase treatment. During the first phase treatment, and the hereinafter described intermediate phase treatment, pressure differential across filters 8 and 9 is also continuously monitored and appropriate corrective measures are taken, as hereinafter described, in the event the maximum pressure differentials are reached or exceeded. Since, however, the maximum pressure differential across filters 8 and 9 is not normally reached or exceeded during the first phase treatment, the description of operation of filters 8 and 9 is made in connection with the description of the intermediate phase treatment.

When the first phase treatment is complete, as indicated previously, the intermediate phase treatment is immediately started. The only substantial distinctions between the first phase treatment and the intermediate phase treatment reside in the heating and cooling rates of the oil, but not the temperature maintenance times thereof, and in the shifting of the primary filtering elements from strainers 6 and 7 to 25 micron filters 8 and 9.

During the intermediate phase treatment, the uniform oil heating rate is increased to produce an oil temperature differential of 15° to 30°F across heat exchanger 4. Accordingly, steam inlet valve 23 is adjusted to produce sufficient steam introduction into indirect heat exchanger 4 to produce a temperature at point C in the range of about 15° to 30°F greater than the temperature at point B. The temperature at point C is increased at the above heating rate to the previously established maximum of 200°F, at which time valve 23 is adjusted to maintain sufficient steam flow to exchanger 4 in order to stabilize and maintain the temperature at C at 200°F for about 1 to 2 hours. When the temperature maintenance time is complete, valves 23 and 24 are closed and valves 21 and 22 are opened. Valve 21 is adjusted to produce a sufficient flow of ambient cooling water to heat exchanger 4 to produce an oil temperature at point C downstream of exchanger 4 in the range of about 15° to 30°F lower than the oil temperature upstream of exchanger 4 at point B. The temperature at point C is decreased at the above cooling rate to the previously defined equilibrium temperature. The equilibrium temperature is then maintained for 1 to 2 hours by appropriate manipulation of valves 21 and 22, after which time valves 21 and 22 are closed and the described intermediate phase heat, cool and temperature maintenance cycle is repeated.

Suring the intermediate phase treatment, the pressure difference across filter 8 (and 9) is constantly monitored. When the pressure of the flowing oil upstream of filter 8, as measured in conduit 57, exceeds the pressure downstream of filter 8, as measured in conduit 58, by about 35 psi, the indication is that the particulate matter trapped in filter 8 is starting to impede satisfactory oil flow.

Accordingly, valves 36 and 37 are opened and valves 34 and 35 are closed. This will terminate flow through filter 8 and initiate flow through filter 9 via conduit 60, valve 36 and conduit 61. Oil flows from filter 9 and through conduit 62, valve 37, and conduit 63 to conduit 40 and system 1.

The pressure difference across filter 9 is monitored just as described with respect to filter 8. Thus, when the pressure when measured in conduit 61 is about 35 psi greater than the pressure as measured in conduit 62, then oil flow through filter 9 is terminated by closing valves 36 and 37 and oil flow through filter 8 is initiated by opening valves 34 and 35. It is to be understood that while oil is flowing through filter 9 and not flowing through filter 8, then the particulate matter trapped in filter 8 is being removed and that filter 8 is being prepared for future use and, conversely, while oil is flowing through filter 8 and not flowing through filter 9, then filter 9 is being similarly cleaned and prepared for future use. Filters 8 and 9 are used in alternate fashion as above described for a period of time sufficient to remove from the circulating oil substantially all suspended matter which will not pass through a 25 micron filter. It is considered that such a condition is established when circulation of oil through a specific filter can be continued for a period of about 24 hours while maintaining substantially constant pressure difference across the filter.

During the intermediate phase treatment, it has been found that removal of adherent scale from the surfaces contacted by the circulating oil in system 1 is enhanced by varying the oil flow rate and by vibration of the system piping, such as by hammering thereof. Flow rate variation and piping vibration should preferably commence after circulation through one of filters 8 or 9 can be continued without necessity of clean-out, as previously described, for periods of at least 12 hours.

During the intermediate phase treatment, loosening and flaking of adherent scale contacted by the circulating oil in system 1 is continued. The loosened scale is carried by the moving oil to one of filters 8 and 9 and trapped therein.

Throughout the entire intermediate phase, the heating and cooling rates and the temperature maintenance times of this phase are continued and the monitoring, controlling and cleaning of strainers 6 and 7 and filters 8 and 9 is continued, also as above described.

When the intermediate phase treatment is complete, as indicated previously, the second phase treatment is immediately started. The only substantial distinctions between the intermediate phase treatment and the second phase treatment reside in the temperature maintenance times of the heated and cooled oil, but the oil heating and oil cooling rates of the intermediate phase are retained. The primary filtering elements of the second phase are again filters 8 and 9; however, the 25 micron filter elements are removed and replaced by 5 micron filter elements; accordingly, during the final 24 hours circulation of the intermediate phase treatment through one of 25 micron filter elements 8 and 9, the 25 micron filter not in use should, during that period, be replaced with a 5 micron element in preparation for the second treatment phase.

During the second phase treatment, the uniform oil heating rate is adjusted to produce an oil temperature differential of 15° to 30°F across heat exchanger 4. Accordingly, steam inlet valve 23 is adjusted to produce sufficient steam flow into indirect heat exchanger 4 to produce a temperature at point C in the range of about 15° to 30°F greater than the temperature at point B. The temperature at point C is increased at the above heating rate to the previously established maximum of 200°F, at which time valve 23 is adjusted to maintain sufficient steam flow to exchanger 4 in order to stabilize and maintain the temperature at C at 200°F for about 4 to 6 hours. When the temperature maintenance time is complete, valves 23 and 24 are closed and valves 21 and 22 are opened. Valve 21 is adjusted to produce a sufficient flow of ambient cooling water to heat exchanger 4 to produce an oil temperature at point C downstream of exchanger 4 in the range of about 15° to 30°F less than the oil temperature upstream of exchanger 4 at point B. The temperature at point C is decreased at the above cooling rate to the previously defined equilibrium temperature. The equilibrium temperature is then maintained for 3 to 4 hours by appropriate manipulation of valves 21 and 22, after which time valves 21 and 22 are closed and the described second phase heat, cool and temperature maintenance cycle is repeated.

The rapid heating and cooling rates of this second stage treatment and the long temperature maintenance times of this second stage treatment enable maximum expansion and contraction of any remaining weld slag and spatters, mill scale, rust, and the like, as well as maximum expansion and contraction of the piping in system 1.

During the second phase treatment, the steps involved in alternating flow through filter 8 and filter 9, both of which contain 5 micron filtering elements during the second phase treatment, is conducted in the same manner as described above with respect to the intermediate phase treatment.

The circulation, heating and cooling, and temperature maintenance times of the second phase treatment is continued until the pressure difference across one of filters 8 and 9 remains substantially unchanged for a period of about 24 hours. At this point, sample collection of oil returned from system 1 should begin. Accordingly, about once every 24 hours, beginning from the time the pressure drop across any one of 5 micron filters 8 and 9 is relatively constant for about 24 hours, an oil sample is removed from a point downstream of system 1, such as from conduit 64. The sample should be taken preferably at maximum oil flow rate and a particle count made on a 100 milliliter portion of the sample. The entire cleaning process is considered to be complete when the sample analysis is within some satisfactory maximum allowable range. An example of maximum allowable range for SAE class 4 oil for a 100 milliliter sample is provided below:

MAXIMUM ALLOWABLE PARTICLE SAMPLE COUNT

| Particle Size (Microns) | Maximum Allowable Particles in 100 ml Sample |
|---|---|
| 5 – 10 | 32,000 |
| 10 – 25 | 10,700 |
| 25 – 50 | 1,510 |
| 50 – 100 | 225 |
| 100 – 250 | 21 |
| Over – 250 | 0 |

Upon completion of the process, that is when the particle size distribution is within some maximum allowable range such as the one set out above, conduits and surfaces contacted by the oil within system 1 have been observed to be in a bright condition similar to the condition obtained upon sand blasting or shot blasting of ferrous metals.

Depending upon the volume of system 1 the entire process of this invention, from initial circulation through trap 2, through particle size analysis, can continue for a time of about 21 to 25 days; however, the usual time is in the range of from 9 to 21 days.

This invention is not limited to the above described specific embodiments thereof; it must be understood therefore that the detail involved in the descriptions of the specific embodiments is presented for the purpose of illustration only, and that reasonable variations and modifications, which will be apparent to those skilled in the art, can be made in this invention without departing from the spirit or scope thereof.

I claim:

1. A process for dislodging adherent deposits from surfaces in a system having a liquid therein, the system having the surfaces in direct contact with said liquid of the system, which process consists essentially of the sequential steps of:

while maintaining in the system said liquid of the system, a. contacting the deposit-containing surfaces with said liquid of the system at a first temperature;

b. increasing the temperature of said liquid at a controlled heating rate in the range of about 40° to about 160°F per hour to a predetermined second temperature;

c. maintaining the temperature of said liquid at said second temperature for a first period of time;

d. decreasing the temperature of said liquid at a controlled cooling rate in the range of about 80° to about 320°F per hour to a third temperature; and e. maintaining the temperature of said liquid at said third temperature for a second period of time to thereby dislodge at least a portion of said deposits from said surface.

2. The process of claim 1 wherein said liquid is a lubricating oil.

3. The process of claim 2 wherein said liquid is in motion during said steps (a), (b), (c), (d) and (e).

4. The process of claim 1 wherein said first period of time is in the range of about 1 to about 6 hours and sais second period of time is in the range of about 1 to about 4 hours.

5. The process of claim 1 wherein said steps (a), (b), (c), (d) and (e) are repeated a sufficient number of times to dislodge substantially all of said deposits from said surfaces.

6. The process of claim 1 wherein said deposits become suspended in said liquid subsequent to said dislodgement and said suspended deposits are thereafter filtered from said liquid.

7. A process according to claim 1 wherein said system is a circulating liquid system and said liquid is the circulating liquid.

8. A process according to claim 7 wherein said system is a lube oil system of a turbine and said liquid is the lube oil.

9. A process for dislodging adherent deposits from surfaces in a system having a liquid therein, the system having the surfaces in direct contact with said liquid of the system, which process consists essentially of the sequential steps of:

while maintaining in the system said liquid of the system, a. contacting the deposit-containing surfaces with said liquid of the system at a first temperature;

b. increasing the temperature of said liquid at a controlled heating rate to a predetermined second temperature;

c. maintaining the temperature of said liquid at said second temperature for a first period of time;

d. decreasing the temperature of said liquid at a controlled cooling rate to a predetermined third temperature; and e. maintaining the temperature of said liquid at said third temperature for a second period of time;

steps (a) to (e) being conducted in a first phase to achieve a steady state heat transfer across said deposits but not across said surfaces and steps (a) to (e) being conducted in a subsequent phase to achieve a steady state heat transfer across both said deposits and said surfaces to thereby dislodge at least a portion of said deposits from said surface.

10. A process for dislodging aherent deposits from surfaces comprising the sequential steps of:

a. contacting the deposit-containing surfaces with a lubricating oil at a first temperature;

b. increasing the temperature of said lubricating oil at a controlled heating rate to a predetermined second temperature;

c. maintaining the temperature of said lubricating oil at said second temperature for a first period of time;

d. decreasing the temperature of said lubricating oil at a controlled cooling rate to a third temperature; and e. maintaining the temperature of said lubricating oil at a third temperature for a second period of time to thereby dislodge at least a portion of said deposits from said surfaces;

and wherein said lubricating oil is in motion during steps (a), (b), (c), (d) and (e) and wherein said controlled heating rate is in the range of about 40° to about 160°F per hour and said controlled cooling rate is in the range of about 80° to about 320°F per hour.

11. The process of claim 10 wherein said first period of time is in the range of about 1 to about 6 hours and said second period of time is in the range of about 1 to about 4 hours.

12. The process of claim 11 wherein said first temperature is ambient temperature.

13. The process of claim 12 wherein said steps (a), (b), (c), (d) and (e) are repeated a sufficient number of times to dislodge substantially all of said deposits from said surfaces.

14. The process of claim 13 wherein said deposits become suspended in said liquid subsequent to said dislodgement and said suspended deposits are thereafter filtered from said liquid.

15. The process of claim 14 wherein said surfaces are metal surfaces.

16. A process for removing adherent deposits from ferrous metal surfaces comprising:

a. introducing a lubricating oil into a first heat transfer zone;

b. increasing the temperature of said lubricating oil at a controlled heating rate in said first heat transfer zone from a first temperature to a second temperature, wherein said second temperature does not exceed a predetermined third temperature, and further wherein a temperature differential between said second temperature and said first temperature is in the range of about 10° to about 30°F;

c. introducing said oil at said second temperature into a contact zone wherein said deposit-containing ferrous metal surfaces are contacted by said oil;

d. recycling said oil to said first heat transfer zone to thereby establish heating circulation of said oil between said first heat transfer zone and said contact zone;

e. repeating said steps (b), (c), and (d) until said second temperature is substantially equal to said third temperature;

f. continuing said heating circulation while adjusting said heating rate in said first heat transfer zone to maintain said third temperature substantially constant for a first period of time in the range of about 1 to about 6 hours;

g. introducing said oil at said third temperature, subsequent to termination of said first period of time, into a second heat transfer zone;

h. decreasing the temperature of said oil at a controlled cooling rate in said second heat transfer zone from said third temperature to a fourth temperature, wherein a temperature differential between said third temperature and said fourth temperature is in the range of about 10° to about 30°F;

i. introducing said oil at said fourth temperature into said contact zone;

j. recycling said oil to said second heat transfer zone to thereby establish cooling circulation of said oil between said second heat transfer zone and said contact zone;

k. repeating said steps (h), (i) and (j) until said fourth temperature is equal to a fifth temperature;

l. continuing said cooling circulation while adjusting said cooling rate in said second heat transfer zone to maintain said fifth temperature for a second period of time in the range of about 1 to about 4 hours to thereby remove at least a portion of said deposits from said surfaces.

17. The process of claim 16 wherein said steps (a) through (1) inclusive are repeated a sufficient number of times to remove substantially all of said deposits from said surfaces.

18. The process of claim 17 comprising performing said steps (a) through (1) in phases, said phases being performed in the order of a first phase, an intermediate phase and a second phase: wherein said first phase said temperature differential produced by said heating rate is in the range of 10° to 15°F, said first period of time is in the range of 1 to 2 hours, said temperature differential produced by said cooling rate is in the range of 10° to 15°F and said second period of time is in the range of 1 to 2 hours.

19. The process of claim 18 wherein said intermediate phase said temperature differential produced by said heating rate is in the range of 15° to 30°F, said first period of time is in the range of 1 to 2 hours, said temperature differential produced by said cooling rate is in the range of 15° to 30°F and said second period of time is in the range of 1 to 2 hours.

20. The process of claim 19 wherein said second phase said temperature differential produced by said heating rate is in the range of 15° to 30°F, said first period of time is in the range of 4 to 6 hours, said temperature differential produced by said cooling rate is in the range of 15° to 30°F and said second period of time is in the range of 3 to 4 hours.

21. The process of claim 20 wherein said third temperature is less than the thermal degradation temperature of said oil.

22. The process of claim 21 wherein said fifth temperature is the heat transfer equilibrium temperature.

23. The process of claim 22 wherein said first temperature and said fifth temperature are substantially the same.

24. The process of claim 23 wherein said deposits become suspended in said oil subsequent to said removal and said suspended deposits are thereafter filtered from said oil.

25. The process of claim 24 wherein said contact zone is the lube oil system of a turbine.

* * * * *